US005890670A

United States Patent [19]

Zenoni et al.

[11] Patent Number: 5,890,670

[45] Date of Patent: Apr. 6, 1999

[54] DEVICE FOR SPACING TURNS OF THREAD FOR WEFT FEEDERS

[75] Inventors: Pietro Zenoni, Via Montegrappa; Giovanni Pedrini, Via Mosconi, both of Italy

[73] Assignee: L.G.L. Electronics S.p.A., Gandino, Italy

[21] Appl. No.: 921,557

[22] Filed: Sep. 2, 1997

[30] Foreign Application Priority Data

Sep. 11, 1996 [IT] Italy ..... TO960183 U

[51] Int. Cl.[6] ..... D03D 47/36; B65H 51/20

[52] U.S. Cl. ..... 242/366.2; 139/452

[58] Field of Search ..... 242/365.3, 365.4, 242/365.5, 366.2; 139/452

[56] References Cited

U.S. PATENT DOCUMENTS

| | | | |
|---|---|---|---|
| 2,244,119 | 6/1941 | Samerdyke | 242/366.2 |
| 3,796,386 | 3/1974 | Tannert | 139/452 X |
| 4,632,154 | 12/1986 | Maina | 242/365.3 X |
| 4,638,840 | 1/1987 | Ghiardo et al. | 242/365.3 X |
| 4,747,549 | 5/1988 | Balzarotti | 139/452 X |
| 5,520,226 | 5/1996 | Pedrini | 139/452 |

FOREIGN PATENT DOCUMENTS

| | | |
|---|---|---|
| 164 033 | 12/1985 | European Pat. Off. . |
| 244 511 | 11/1987 | European Pat. Off. . |
| 381 622 | 10/1964 | Switzerland . |
| 90 00149 | 1/1990 | WIPO . |

*Primary Examiner*—Michael Mansen
*Attorney, Agent, or Firm*—Guido Modiano; Albert Josif

[57] ABSTRACT

A device for spacing the turns of thread for weft feeders, which comprises a set of turn movement rods which are connected to a hub by respective spokes, wherein the hub is mounted so that it can rotate freely on a bush which is fitted on an eccentric portion of the driving shaft of the feeder and is inclined at a constant angle with respect to the axis of said eccentric portion in order to cause the cyclic and partial protrusion of the rods from corresponding slots of the drum of the feeder, and wherein the keying angle of the bush on the eccentric portion of the driving shaft is variable in order to correspondingly vary the spacing pitch of the turns on the drum. According to the invention, the axis of the bush, in the configuration in which the keying angle is zero, intersects the axis of the driving shaft in a point which is adjacent to the free end of the drum and is located, relative to the advancement direction of the thread, downstream of the transverse plane that contains the axes of the spokes.

4 Claims, 5 Drawing Sheets

DEVICE FOR SPACING TURNS OF THREAD FOR WEFT FEEDERS

BACKGROUND OF THE INVENTION

The present invention relates to devices for spacing the turns of thread for units for feeding weft to textile machines, particularly weaving looms.

More specifically, the present invention relates to weft feeders which comprise a fixed drum, on which a windmilling hollow arm winds a plurality of weft reserve turns and from which said turns unwind, when required, by the loom under the control of a braking element which ensures the necessary mechanical tension of the thread.

It is well-known to those skilled in the art that such weft feeders have a movement device suitable to move the turns wound by the windmilling arm from the base of the drum to its free end; the device also mutually spaces the turns by an extent, or spacing pitch, which can be changed within certain limits in order to pack or spread out the turns to correspondingly vary the weft reserve.

This conventional device is constituted by a set of movement rods which partially and cyclically protrude from corresponding slots of the drum and are subjected to a movement system which is suitable to give them a substantially undulatory motion, through which all the turns are cyclically lifted from the surface of the drum and deposited back onto it after they have been moved forward longitudinally, towards the free end of the drum, by an extent which is equal to the spacing pitch.

The movement rods, which are parallel to the generatrices of the drum, are individually connected, by means of corresponding spokes and in a swift-like configuration, to a central hub which is rotationally coupled, with the interposition of a rolling bearing, so that the movement swift is rotationally fixed, to a bush whose axis is oblique with respect to the axis of the driving shaft of the weft feeder. More specifically, the bush is fitted on an eccentric portion of the driving shaft or on an eccentric sleeve which is keyed on the shaft and in any case forms an eccentric axis, and has an axial hole which is tilted at a preset angle $\alpha$ with respect to the eccentric driving axis.

From the prior utility model no. 198.379, which relates to a system of this kind, it is known to vary through 180° the angular position of the bush with respect to the eccentric sleeve (or, in an equivalent manner, with respect to the eccentric portion of the driving shaft) in order to allow the advancement of the turns of the weft reserve for both directions of rotation S, Z (counterclockwise and clockwise) of the driving shaft that turns the windmilling winder arm; this is required in order to adapt to the direction of the twisting of the fed weft thread in order to avoid untwisting its fibers, especially during unwinding from the drum of the feeder.

In order to vary the spacing pitch of the turns, it is also known to vary the angle $\alpha$ of inclination of the bush, as described in Italian patent no. 1,204,330, or the angle $\beta$ at which the bush is keyed onto the eccentric portion of the driving shaft with respect to a reference plane, which is chosen so that it coincides with the diametrical plane that contains both the driving axis and the eccentric axis.

In known systems of the second type, the arrangement of the bush with respect to the driving shaft is such that— as described and illustrated hereinafter with reference to FIG. 4—in the configuration in which the keying angle is zero, the axis of the bush intersects the rotation axis of the driving shaft in a point which is adjacent to the base of the drum of the feeder and is located—relative to the advancement direction of the thread—upstream of the diametrical plane that contains the axes of the spokes of the movement rods. With this conventional arrangement, the adjustment range of the keying angle $\beta$, which determines the spacing pitch between the turns, is between −90° and +90° with respect to the reference plane $\beta=0$ and the spacing pitch becomes zero for a corresponding nil value of the keying angle.

In conventional systems of the first kind too, the spacing pitch becomes zero when the angle $\alpha$ of the bush becomes zero. This is a considerable functional drawback, which forces one to act on the bush to vary its inclination or respectively its keying angle whenever the direction of rotation of the driving shaft is changed in order to adapt it to the direction of the twisting of the thread being processed.

In particular, in conventional devices of the second type, if a keying angle of for example +15° is set for counterclockwise rotation S, producing a spacing pitch which has a preset value, when the direction of rotation Z is assumed it is necessary, in order to keep the spacing pitch unchanged, to turn the bush symmetrically with respect to the reference plane, so that the keying angle is $\beta=-15°$.

SUMMARY OF THE INVENTION

In the improvement according to the present invention, this severe drawback is surprisingly overcome with an inverted arrangement of the bush, whose axis, arranged at a constant angle of inclination $\alpha$, thus intersects, in the configuration in which the keying angle $\beta$ is zero, the axis of the driving shaft in a point which is adjacent to the free end of the drum and is located, relative to the advancement direction of the thread, downstream of the diametrical plane that contains the axes of the spokes of the movement rods.

With this improved arrangement, the spacing pitch of the turns no longer becomes zero when the keying angle becomes zero; on the contrary, it is indeed advantageously identical for the two directions of rotation S and Z when the keying angle $\beta$ is zero, whilst in a rather wide neighborhood of the zero value of the keying angle it assumes values which differ very little for the two directions of rotation. In said neighborhood, the keying angle $\beta$ can thus remain unchanged, without appreciable variations of the spacing pitch, when the direction of rotation of the windmilling arm is changed in order to adapt it to the direction of the twisting of the thread being processed.

BRIEF DESCRIPTION OF THE DRAWINGS

The present invention will become apparent from the following detailed description and with reference to the accompanying drawings, which are given by way of example and wherein.

DESCRIPTION OF THE PREFERRED EMBODIMENTS

Figure 1:
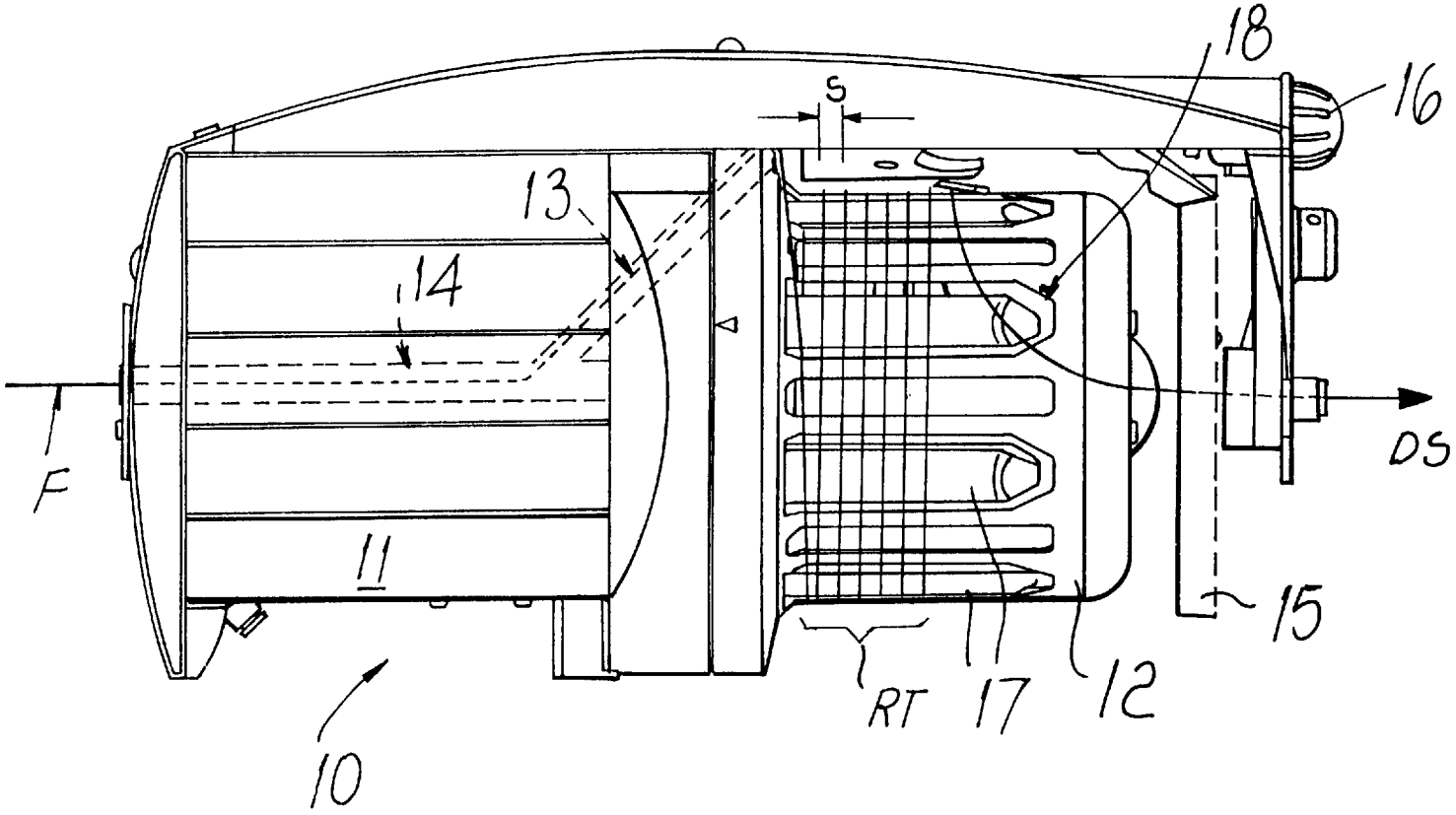
FIG. 1 is a lateral elevation view of a weft feeder.

Initially with reference to FIG. 1, the reference numeral 10 generally designates a conventional weft feeder which comprises a fixed base 11 and a fixed drum 12 on which a hollow arm 13, actuated by the hollow driving shaft 14 of the feeder 10, winds in a windmilling fashion a plurality of turns of thread F which constitute a weft reserve RT.

When required by the loom or other textile machine, the turns of the reserve RT unwind from the free end of the drum in the advancement direction DS, under the control of a braking means (not shown) supported by a supporting ring 15, whose axial position can be changed by means of a knob 16 to adjust the braking action.

Figure 2:
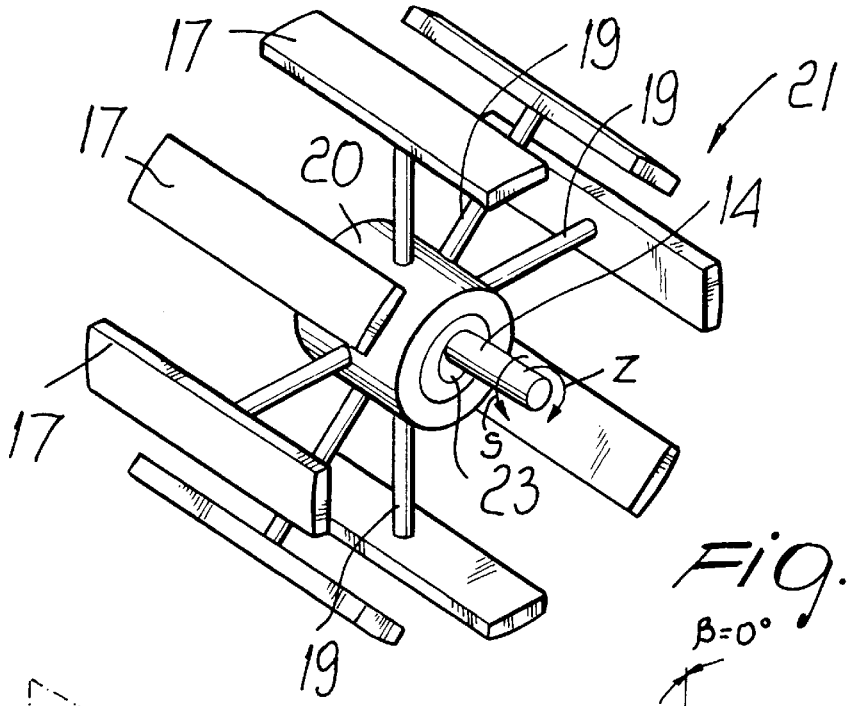
FIG. 2 is a schematic perspective view of the system for moving and spacing the turns of thread on the drum of the feeder of FIG. 1.
Figure 3A:
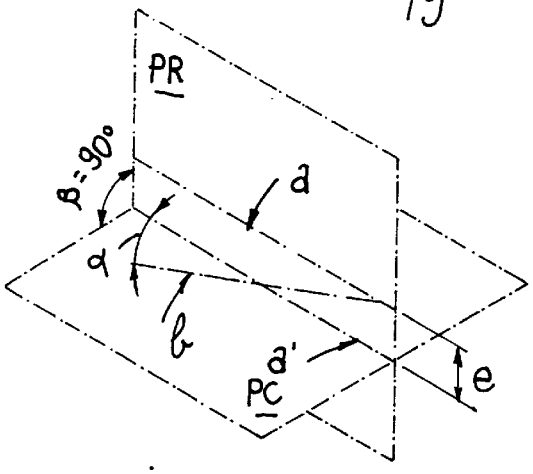
FIGS. 3*a*–3*c* are perspective views of the keying angle $\beta$ of the bush of the movement and spacing system of FIG. 2.
Figure 3B:
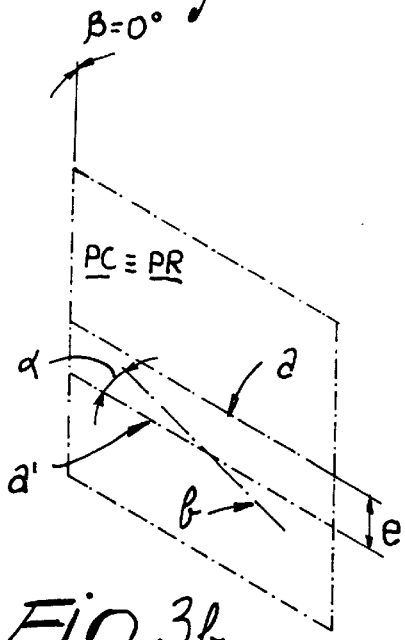
Figure 3C:
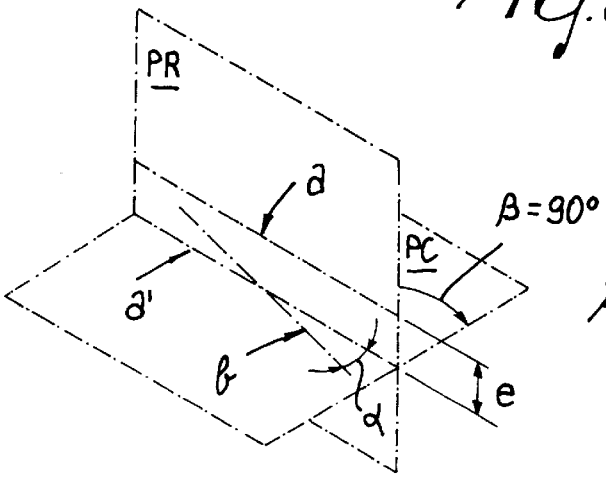

A movement system is associated with the drum 12 and is suitable to move the turns wound by the windmilling arm 13 from the base towards the free end of the drum 12, keeping them spaced by an extent s, termed spacing pitch, which can be changed within preset limits. In a per se known manner, the movement system is constituted by a set of movement rods 17, which protrude partially and cyclically from corresponding slots 18 provided on the cylindrical surface of the drum 12. The rods 17 are individually connected, by means of corresponding spokes 19, to a central hub 20 in order to substantially form a swift-like structure 21 (FIG. 2). The hub 20 is rotationally coupled, with a rolling bearing 22 interposed (FIGS. 4 and 5), to a bush 23 which is fitted on an eccentric portion 14*a* of the shaft 14 which has an eccentric axis a', with respect to which the axis b of the bush forms a constant inclination angle α. The keying angle β of the bush 23 on the eccentric portion 14*a* of the driving shaft can vary in order to correspondingly vary the spacing pitch s of the turns; the keying angle β is defined as the angle formed by the keying plane PC (FIG. 3*a*–3*c*), which contains the axes a' and b, with the plane PR, which contains both the driving axis and the eccentric axis a–a' and is taken as a reference plane.

Accordingly, in the configuration in which the keying angle is zero, i.e., when β=0 (FIG. 3*b*), the axis b of the bush also lies within the reference plane PR and forms the angle α with both axes a–a' of the driving shaft 14 and of its eccentric portion 14*a*.

Figure 4:
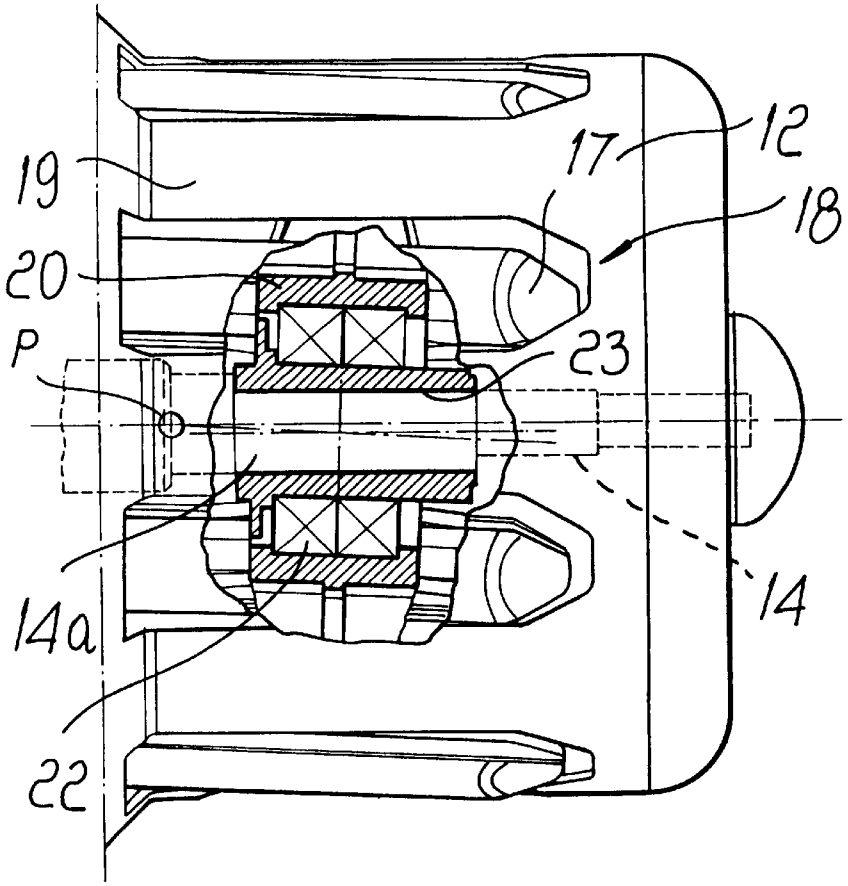
FIG. 4 is a partially sectional view of a detail of FIG. 1, illustrating the conventional arrangement of the bush of the movement and spacing system of FIG. 2.
Figure 7:
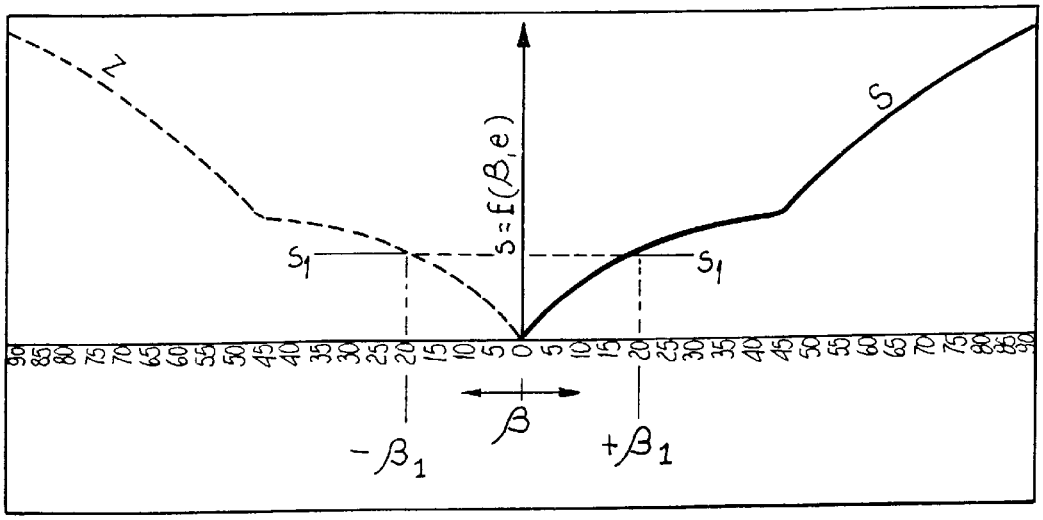
FIG. 7 is a chart which plots the variation of the spacing pitch as the keying angle of the bush varies in conventional turn spacing devices.

FIG. 4 shows that in conventional turn movement and spacing systems the axis b of the bush, in the configuration in which the keying angle β is zero, intersects the axis a of the driving shaft in a point P which is adjacent to the base of the fixed drum 12 and is located, with reference to the direction DS in which the thread F advances, upstream of the transverse plane PT which contains the axes of the spokes 19. With this conventional arrangement of the bush 23, the variation in the spacing pitch s, which is a function of the keying angle β and of the eccentricity e of the axis a' with respect to the axis a, i.e., s=f(β,e), when the angle β varies, behaves—as observed experimentally—as shown in the chart of FIG. 7, where the solid curve relates to the rotation direction S and the dashed curve relates to the opposite rotation Z; the two curves are perfectly symmetrical with respect to the axis of the ordinates, which coincides with the zero value of the keying angle β.

Inspection of the chart shows that with the conventional arrangement of the bush 23 shown in FIG. 4, the spacing pitch sbecomes zero for β=0 and that by varying the direction of rotation from S to Z or vice versa it is necessary, for an equal value s1 of the spacing pitch, to vary the keying angle from β to −β, for example from +20° to −20°; the range of variation of the keying angle β, which is symmetrical with respect to the configuration β=0, is variable between +90° and −90°.

Figure 5:
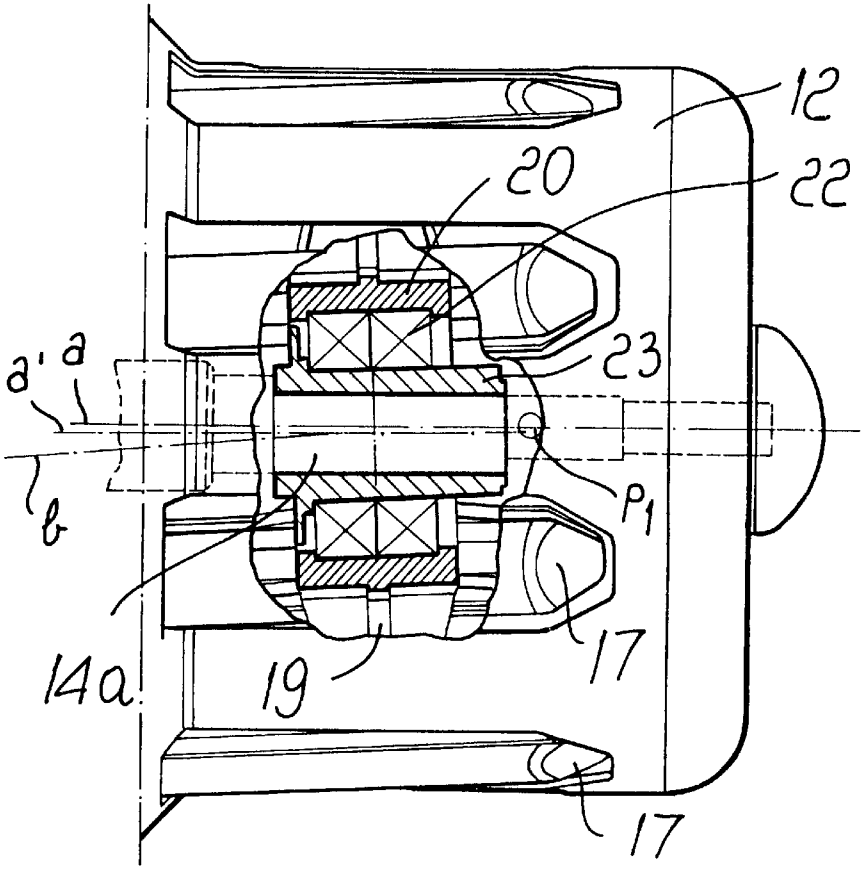
FIG. 5 is a detail view, similar to FIG. 4, of the arrangement of the bush according to the present invention.
Figure 6:
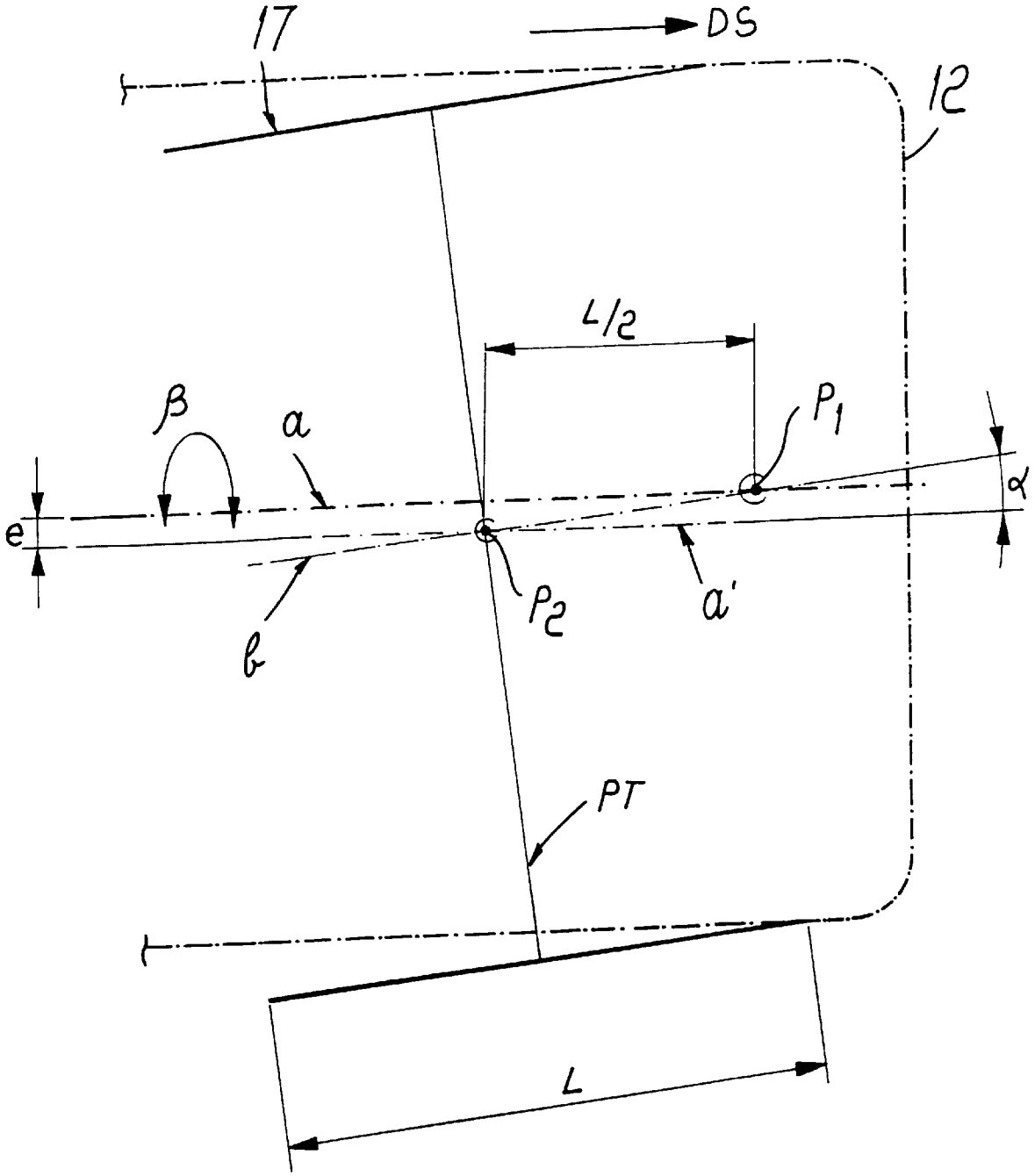
FIG. 6 is a schematic detail view of the mutual geometric arrangement of the driving axis, of the eccentric axis and of the axis of the bush of FIG. 5 in the configuration in which the keying angle is zero.

According to the present invention, these drawbacks are avoided with an inverted arrangement of the bush 23, which is in other words arranged as shown in FIGS. 5 and 6. These figures show that for the configuration in which the keying angle β is zero, the axis b of the bush 23, which is inclined by an angle α with respect to the eccentric axis a', intersects the axis a of the driving shaft in a point P1 which is adjacent to the free end of the drum and is located —relative to the thread advancement direction DS—downstream of the plane PT that contains the axes of the spokes 19.

Advantageously, according to the present invention, the distance of the point P1 from the point P2 where the axis b of the bush intersects the eccentric axis a' is chosen so that it is preferably equal to L/2 or higher, L being the axial extension of the movement rods 17; this is achieved by taking, for the inclination angle α, the value $$\alpha = \text{arctg } 2.e/L$$

where e is the eccentricity of the axis a' with respect to the driving axis a, which is in turn preferably chosen smaller than, or equal to, 3 mm in order to contain the vibrations of the system.

Figure 8:
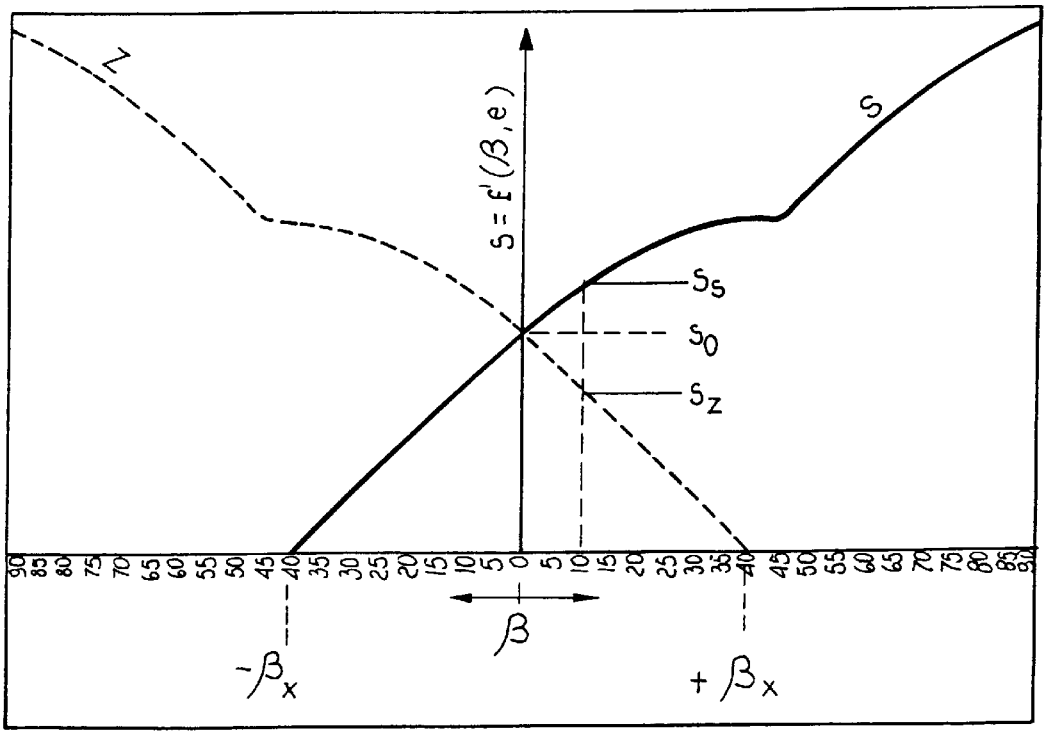
FIG. 8 is a chart, similar to FIG. 7, of the variation of the spacing pitch as the keying angle of the bush varies in the device according to the present invention.

With the improved arrangement according to the present invention, the variation of the turn spacing pitch s when the keying angle β of the bush varies behaves, as observed experimentally, in the manner shown in the chart of FIG. 8. This behavior of the pitch s is a function f' of the keying angle, i.e., s=f'(β,e), which is plotted by the solid curve for counterclockwise rotation S and by the dashed curve for clockwise rotation Z; the two curves are identical and symmetrical with respect to the axis of the ordinates β=0.

The curves show:

a) that when the keying angle β is zero, the spacing pitch s does not become zero as in conventional systems, but assumes a value $s_o$ which is identical for both directions of rotation S and Z; accordingly, transition from one direction of rotation to the other requires no variation of the keying angle;

b) that the variation range of the keying angle spans from −βx to +90° and respectively from βx to −90° and is thus greater than 90° for the two directions of rotation S and Z;

c) that in a wide neighborhood of the nil value of the keying angle β, the spacing pitch s varies within narrow limits; one has, for example, for β=10° (or −10°), $s=s_s$ for counterclockwise rotation and $s=s_z$ for clockwise rotation, where $s_z=0.65s_s$, a percentage decrease which normally is an acceptable variation of the pitch s in transition from one direction of rotation to the other and therefore does not require variations of the keying angle β with respect to the change in the direction of rotation of the driving shaft 14.

It is easily understood that in accordance with the stated aim and objects, these surprising results significantly facilitate the running of the feeder 10 equipped with the improved device according to the present invention, eliminating most of the actions for varying the keying angle β, whose value, in the usual operating range, is normally between 10° and 20°.

The effects of the present invention of course also extend to devices which achieve equal utility by using the same inventive concept defined by the appended claims.

What is claimed is:

1. A device for spacing the turns of thread for weft feeders, comprising a set of turn movement rods which are connected to a hub by means of respective spokes, wherein said hub is mounted so that it can rotate freely on a bush which is fitted on an eccentric portion of the driving shaft of the feeder and is inclined at a constant angle with respect to an axis of said eccentric portion in order to cause a cyclic partial protrusion of the rods from corresponding slots of the drum of the feeder, and wherein the keying angle of the bush on the eccentric portion of the driving shaft is variable in order to correspondingly vary the spacing pitch of said turns on said drum before operating said drum; wherein an axis of the bush, in a configuration in which the keying angle is zero, intersects the axis of the driving shaft in a point which is adjacent to a free end of the drum and is located, relative to an advancement direction of the thread, downstream of a transverse plane that contains the axes of the spokes.

2. A device according to claim 1, wherein the distance between said point of intersection of the axis of the bush with the axis of the driving shaft and the point of intersection of the axis of the bush with the eccentric axis is chosen greater than, or equal to, L/2, where L is the axial extension of the rods for moving the turns of thread.

3. A device according to claim 2, wherein the angle of inclination of the axis of the bush with respect to the axis of the eccentric portion of the driving shaft is ruled by the following relation:

$$\alpha = \text{arctg } 2.e/L$$

where e is the eccentricity of the axis of the eccentric portion of the driving shaft with respect to the axis of said driving shaft.

4. A device according to claim 3, wherein the eccentricity e is chosen smaller than, or equal to, 3 mm.

* * * * *